United States Patent [19]

Terzian

[11] Patent Number: 4,898,341

[45] Date of Patent: Feb. 6, 1990

[54] METHOD OF GUIDING MISSILES

[75] Inventor: John Terzian, Winchester, Mass.

[73] Assignee: Raytheon Company, Lexington, Mass.

[21] Appl. No.: 256,511

[22] Filed: Oct. 12, 1988

[51] Int. Cl.[4] ..... F41G 7/22

[52] U.S. Cl. ..... 244/3.16; 244/3.17

[58] Field of Search ..... 244/3.15, 3.16, 3.17; 235/411, 412

[56] References Cited

U.S. PATENT DOCUMENTS

| | | | |
|---|---|---|---|
| 3,416,752 | 12/1968 | Hembree | 244/3.17 |
| 3,586,770 | 6/1971 | Bonebreak et al. | 244/3.17 |
| 3,955,046 | 5/1976 | Ingham et al. | 244/3.17 |
| 4,133,004 | 1/1979 | Fitts | 244/3.16 |
| 4,162,775 | 7/1979 | Voles | 244/3.17 |

*Primary Examiner*—Charles T. Jordan

*Attorney, Agent, or Firm*—Edmund J. Walsh; Richard M. Sharkansky

[57] ABSTRACT

A method of guiding a missle during the terminal phase of an intercept. Images, successively formed as the missile approaches the target areas, are represented by a set of vectors. As the missile approaches the target, the image of the target appears to grow larger, and an estimate of the growth is computed. One vector is selected as an aim point, and the missile is guided towards that point. In one embodiment, well-suited for use on small targets, a vector is also selected as a track point, and the distance between the aim point and the track point is computed. The seeker head is controlled to keep the track point in the image and the aim point is located by multiplying the distance between the track point and the aim point by the growth factor. In a second embodiment, well-suited for use with large targets, a track point is selected very near the aim point. As the image grows so that the aim point and track point cannot both be in the field of view, a new track point is selected.

7 Claims, 6 Drawing Sheets

METHOD OF GUIDING MISSILES

BACKGROUND OF THE INVENTION

This invention relates generally to guided missiles, and more particularly to a method of terminal guidance of such a missile.

One known method for determining the position of the target is based on processing signals from a TV or infrared (IR) imaging system to derive the requisite guidance commands. Ordinarily the signals out of an IR or TV sensor are converted to an array of digital words (sometimes hereinafter called "pixels") with the value of each word representing the intensity of IR energy radiating from a different point within a field of view. Electronic circuitry then is used to process the array to select any cluster of pixels that is known, a priori, to correspond with a cluster indicative of a target. Further processing of a selected cluster in any conventional fashion finally produces the requisite guidance commands. These commands are usually based on features of the target including its edges, which define its shape and angular size as seen by the imaging system. Successive frames from the imaging system are processed with the guidance commands generated for each frame, to guide the missile until it intercepts its target.

A problem arises in guiding the missile as it nears its target. The field of view of the IR sensor is generally very narrow. As the missile approaches the target, the target fills more and more of the field of view, creating an effect similar to what is observed when a camera is "zoomed" in for a closeup (sometimes hereinafter called "growth" of the image). At some time during the approach, the target fills the entire field of view. From that time on, the missile is deemed to be in the "terminal phase". During the terminal phase, the features used to generate guidance commands, particularly the edges of the target, may disappear. As the features disappear, the guidance commands may become indeterminate. Alternatively, the system may guide the missile towards an edge which stays in the field of view, and some percentage of missiles will miss the target.

Even in the terminal phase it may be necessary to make course corrections to guide the missile toward the target. In some instances, the field of view of the sensor may be so narrow or the target so large that the missile is an appreciable distance from the target when the target fills the field of view. Without guidance, the missile could drift appreciably off its desired course as it traveled that distance and might miss the target entirely. Alternatively, the target might be so large that the missile must strike a particular aim point in the target to be effective. In such instances, course corrections are needed during the terminal phase of the missile flight to guide it toward the aim point.

One known guidance technique which does not depend upon particular features of the target being within the field of view is correlation tracking. In correlation tracking, a stored scene is compared with the scene from the imaging system. The amount and direction the stored scene must be moved to best match the scene from the imaging system determines the magnitude and direction of the guidance command.

As the missile enters the terminal phase, the image of the target is stored as a reference. The images in successive frames from the imaging systems are then compared with this reference scene to derive the guidance information. Thus, the aim point contained in the reference scene is preserved.

Since the image continues to grow as the range to target decreases, the stored image, which is not growing, will soon not correlate with images in the successive frames. At this point, a new reference image must be exchanged for the stored image. Exchanging reference images continues at an ever increasing rate until target impact.

Every time the stored reference image is exchanged, it incorporates whatever error is present. For example, error is introduced if the first image is exchanged for an image representing a portion of the target slightly offset from the portion of the target represented by the center of the first image. Exchanging images therefore results in noise and drift in the guidance command. The more often the reference scene is exchanged, the larger the drift in guidance command will become. This drift will result in the missile missing its original aim point, and the greater the drift, the greater the miss.

If one considers an incremental area on the target offset from the aim point of the missile and within the field of view, two phenomenon are present as one observes the image received by the missile guidance system as the aim point is approached. First, the image of the incremental area moves out radially from the aim point at a rate proportional to the velocity of the missile and the distance between the aim point and the incremental area. Second, the portion of the image represents the incremental area on the target and will grow with decreasing range. To reduce the number of required reference scene updates, a correlation tracker must address these phenomenon.

In a known variation of a correlation tracker, a cluster of pixels in the image made of the target as it enters the terminal phase is selected as a reference cluster. That cluster is divided into a predetermined number of subclusters. As successive frames are produced, the reference subclusters are independently matched to clusters in the frames. Guidance commands are generated based on the amount and direction all of the subclusters must be moved to best match a portion of the image in a successively generated frame.

The foregoing approach compensates partially for changes between the successive images by allowing the subclusters to be matched to areas that have moved radially outward from the center of the image. It would be desirable to provide an approach which also compensates for growth of the subclusters. It would also be desirable to provide an approach which is computationally simple.

SUMMARY OF THE INVENTION

With the foregoing background of the invention in mind, it is an object of this invention to provide a method of guiding an air-to-ground missile during the terminal phase of an intercept.

It is another object of this invention to provide a computationally simple method to guide a missile which accounts for radial expansion and growth of images.

A further object of this invention is to provide an improved method of guiding a missile during the terminal phase of an intercept, such method being adapted to guiding the missile toward any selected point on the target.

The foregoing and other objects are accomplished by sequentially processing images of the target area. A first image is selected as a reference prior to the missile entering the terminal phase. The reference image is represented as a set of vectors; one of the vectors is selected as an aim point and one of the vectors is selected as a track point. A second image is selected and a growth factor is computed representing the increase in size of objects in the image due to the second image having been formed while the missile is closer to the objects. The second image is likewise represented as a set of vectors and a second track point, corresponding to the first track point, is selected. A second aim point is selected as the point displaced from the second track point an amount equal to the displacement between the first track point and the first aim point multiplied by the growth factor. Control signals are then generated to steer the missile toward a point corresponding to a second aim point and to steer the seeker head of the missile toward the point corresponding to the second track point.

In a second embodiment of the invention the second image is represented by a second set of vectors. The number of vectors in the second set of vectors is reduced in proportion to the growth factor. The reduced second set of vectors is matched to a subset of vectors in the first set of vectors and the vector in the reduced second set corresponding to the first aim point is selected as a second aim point. Control signals are then generated to guide the missile towards the second aim point and to steer the seeker head towards the second aim point.

BRIEF DESCRIPTION OF THE DRAWINGS

The foregoing features of the invention may be more fully understood from the following detailed description and the accompanying drawings in which.

DESCRIPTION OF THE PREFERRED EMBODIMENT

Figure 1:
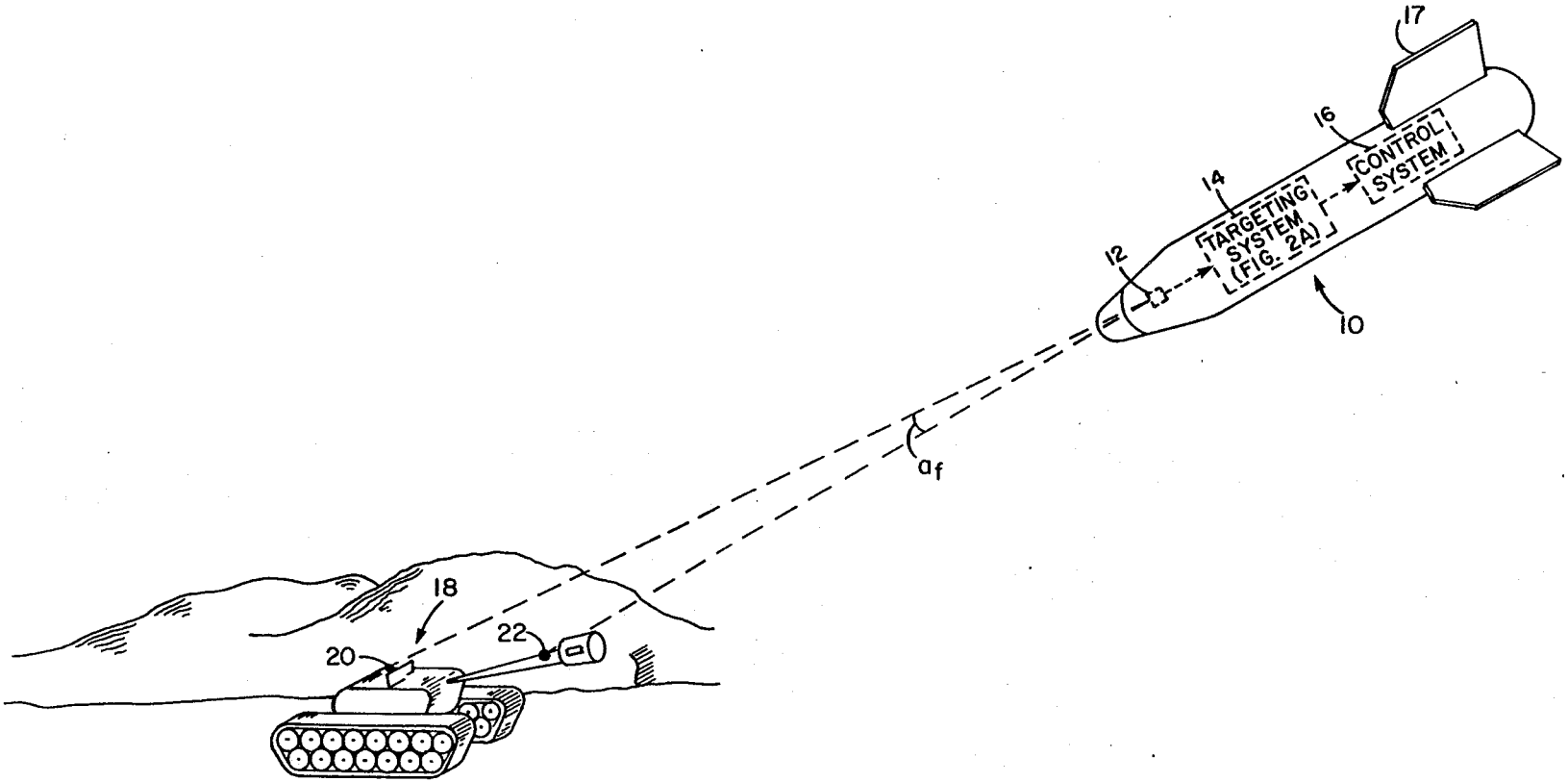
FIG. 1 is a simplified sketch of a scenario in which the present invention might be employed.

FIG. 1 shows a scenario in which the invention might be employed. A missile 10 is fired (possibly from an aircraft, not shown) at a target 18. The missile contains a seeker head 12 which forms a frame representing objects within its field of view. Each frame consists of an array of MxN digital words and contains the image of objects within the field of view. Here, seeker head 12 forms IR images, but one skilled in the art will recognize that seeker head 12 might employ other imaging techniques, such as forming images from visible light.

Targeting system 14 is responsive to the array to compute guidance commands to control the flight path of the missile to an intercept at any desired point on the target 18. The guidance commands are passed to a control system 16 wherein control signals for control surfaces 17 of the missile are generated. Frames are formed sequentially by seeker head 12 at a periodic rate of, say, thirty times a second, and control signals are generated periodically at the same rate.

Seeker head 12 has a narrow field of view which subtends an angle such as that labeled "$a_f$". It should be noted that the field of view actually is encompassed by a solid angle. For simplicity, a cross-section of the field of view is shown in FIG. 1. For the missile position depicted in FIG. 1, the whole field of view is taken up by the portions of the target 18 between points 20 and 22. The missile 10, as shown, may thus be deemed to be in the terminal phase.

The construction of the missile 10 with a control system 16 and control surfaces 17 is known in the art. Similarly, the construction of a seeker head 12 is known. The details of targeting system 14 constructed according to the present invention are described below.

Figure 2A:
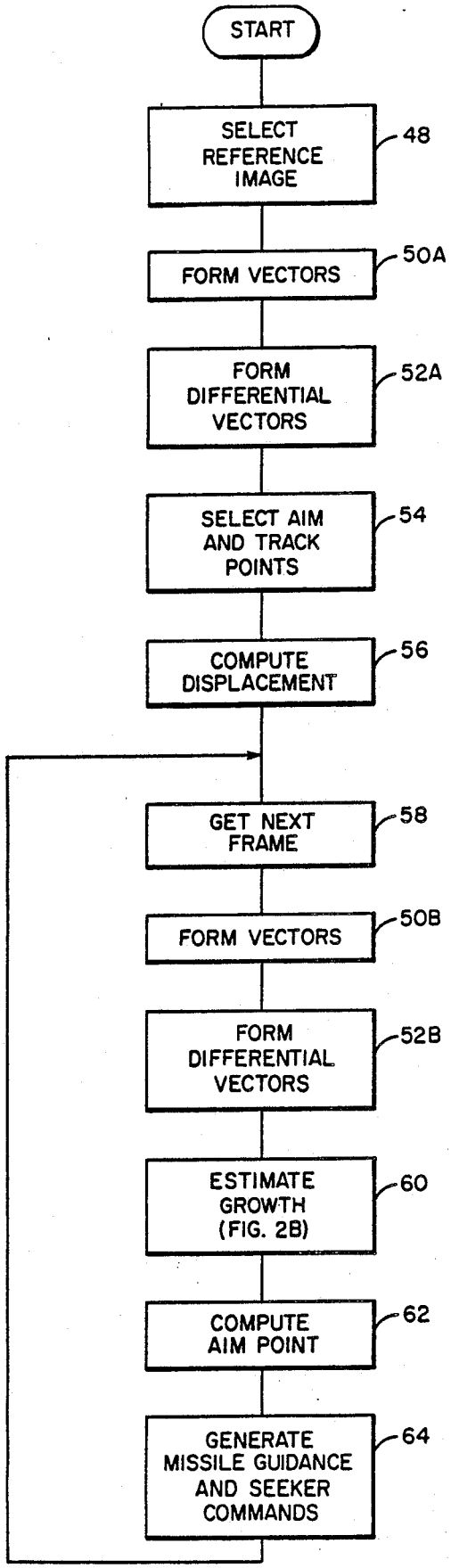
FIG. 2A is a flow diagram of the processing performed by a target identification system operated in accordance with the present invention.

FIG. 2A is a flow diagram of portions of the processing performed in targeting system 14. It will be understood by those of skill in the art that the elements in the FIGS. (here denoted "processing blocks" or "decision blocks" and typified by processing block 48 or decision block 108 in FIG. 2B) represent groups of computer program instructions used to control a digital computer. It will be noted that the flow diagram does not show many of the routine elements of all computer programs, such as the initialization of variables and counters.

The processing shown in FIG. 2A begins as the missile 10 (FIG. 1) nears the point where the target 18 takes up the entire field of view of seeker head 12 (FIG. 1). At that time the entire target 18 (FIG. 1) is represented in the image formed by seeker head 12. Processing block 48 selects that image as a reference image. Processing block 50A represents the reference image as a plurality of "vectors." For the purposes of the processing shown in FIG. 2A, each vector is a single number represented by a program variable. For the MxN array, there will be two sets of vectors, a row set and a column set. The row set will contain N vectors and the column set will contain M vectors. Each row vector is formed by adding all of the elements in one row of the array which makes up the image. The column vectors are similarly formed by adding the digital words in each column of the array.

Processing block 50A also normalizes each set of vectors. The vectors in each set are normalized by first selecting the vector with the largest value from the set. A scale factor is then computed by dividing some constant, say 100, by the largest value. The normalized vectors equal the unnormalized vectors multiplied by the scale factor. Both the row set of vectors and the column set of vectors are processed in a similar manner. For the purposes of describing the invention, only the processing performed on the row set will be described, but it will be understood that similar processing is performed on the column set.

Each set of vectors may be thought of as a function. The row number of the row in the array used to form each vector is the independent variable and the value of each vector is the dependent variable. Hereinafter, references to a particular ordering of the vectors in each set will correspond to the order of the rows used to form each vector. FIG. 3A is a graphical representation of the row set of vectors which might be formed from a target as shown in FIG. 1. The lengths of vectors $200_1$. . . $200_M$ represent the magnitude of the vectors.

Returning to FIG. 2A, processing block 52A operates on the set of vectors to produce a new set of "differential vectors". The set of differential vectors has greater variations than the corresponding row set of vectors and may have both positive and negative values. Such differential vectors are better suited for the processing performed by targeting system 14 (FIG. 1). Each differential vector has a value equal to the difference between the value of the corresponding vector in the set and the twelfth preceding vector. For the first twelve vectors in each set, of course, there will be no vector preceding those vectors by twelve. Hence, in those cases the value of the second vector will be zero.

Figure 3B:
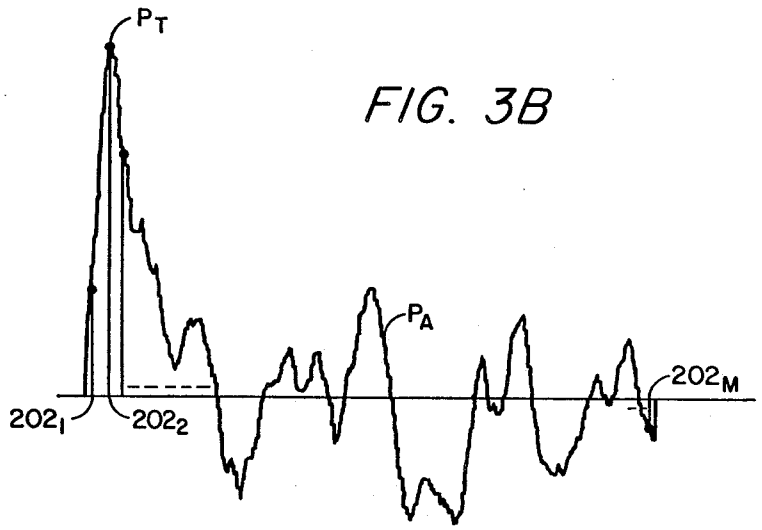
FIG. 3B is a graphical representation of differential vectors formed according to the present invention from the set of vectors represented in FIG. 3A.
Figure 3A:
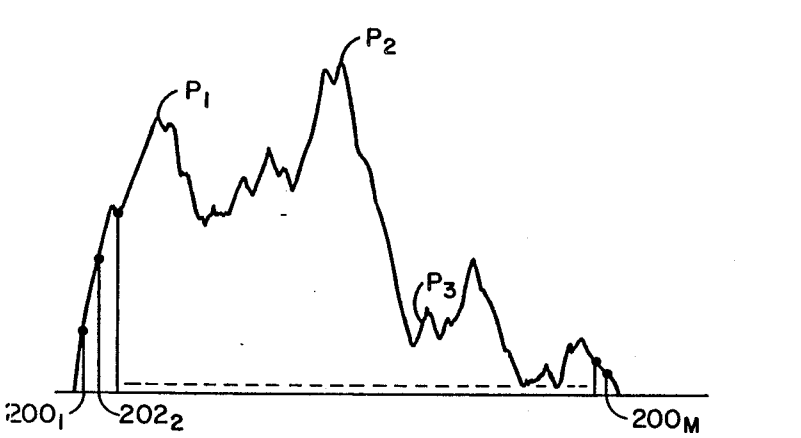
FIG. 3A is a graphical representation of vectors used to characterize an image of an exemplary scene.

FIG. 3B is a graphical representation of the differential vectors $202_1$. . . $202_M$ plotted in a similar fashion as the vectors in FIG. 3A. A little thought will make it clear that the function in FIG. 3B is an approximation of the first derivative of the function in FIG. 3A. Other known methods for estimating the first derivative might be employed by processing block 52A. Additionally, the twelfth preceding vector need not be used, and was selected only because it yielded good empirical results. Any preceding vector could be used instead. However, the operation of processing block 52A described above is relatively simple and can be performed quickly, which is important in a target identifying system 14 such as is shown in FIG. 1.

Processing block 54 in FIG. 2A then selects differential vectors to represent an "aim point" and a "track point". The aim point corresponds to the point on a target toward which the missile is guided. The track point corresponds to some point on the target which can be easily identified by examining the values of the differential vectors. As the missile nears the target, the seeker head 12 (FIG. 1) must be moved, using known control techniques, to keep the track point in the image within a frame. The aim point need not remain in the frame. As the missile nears the target, less and less of the image of the target will be in the frame.

The track point might simply be selected as the first peak of the differential vectors. Track point $P_T$ is shown in FIG. 3B to be selected in this fashion. Additionally, selecting the track point in this fashion is computationally simple, which is desirable. The first peak of the differential vector function almost always corresponds to an edge of the target 18 (FIG. 1) and is very large relative to other peaks in the differential vector function.

Other methods of selecting a track point may also be employed. For example, some targets have "hot spots" caused by engines or other sources of IR energy. Hot spots also appear as very large peaks in the differential vector function and therefore, could readily serve as track points. However, not all targets have hot spots so such a technique is not assured of working in all cases. Alternatively, a track point may be selected by employing a priori knowledge about the target. Thus, known target recognition algorithms employed to guide missiles before the terminal guidance phase may also be used to identify points in the image which may serve as track points.

The aim point may be selected in any number of ways. A simple way is to select as an aim point a point a fixed distance from the track point, say half way to the end of the image. If information is available a priori about the target, such information may be used to select a more desirable aim point. Thus, for example any known target recognition could be used to determine an aim point in a manner similar to that used to determine a track point. One skilled in the art will recognize that many considerations in selecting an aim point are known.

Figure 4:
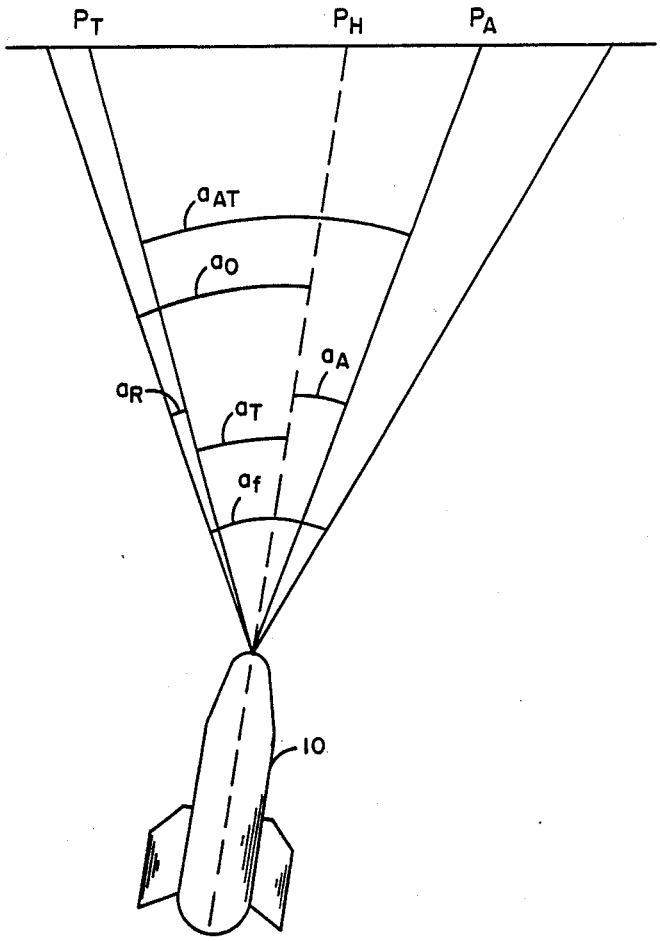
FIG. 4 is a sketch of the geometrical relationships between the field of view of a seeker head mounted on a missile and a target.

When an aim point $P_A$ and track point $P_T$ are selected, the angles between the missile heading $P_H$ and the aim points are computed at processing block 56 (FIG. 2A). FIG. 4 shows the missile 10 prior to entering the terminal guidance phase. Both the track point $P_T$ and aim point $P_A$ are within the field of view of seeker head 12 (FIG. 1) which subtends the angle $a_f$. Since $a_f$ is a characteristic of the seeker head 12 (FIG. 1), it is known and can be used to calculate the angle $a_A$ between the point to which the missile is heading $P_H$ and the aim point $P_A$. The angle $a_A$ represents the required course correction for the missile.

Knowing the angle $a_f$ of the field of view, the angles shown in FIG. 4 can be easily calculated. Where there are N rows in a frame, the angular difference between each row vector is $a_f/N$. The angular separation between the track point $P_T$ and the aim point $P_A$ may then be computed by counting the number of vectors between the vector corresponding to the trackpoint $P_T$ and the vector corresponding to the aim point $P_A$ and multiplying such number by the factor ($a_f/N$). In FIG. 4 this angle is designated $a_{AT}$ and is given by the equation:

$$aAT=X(a_f/N)\ EQ. \quad (1)$$

where X is the number of vectors between $P_T$ and $P_A$. The angle $a_{AT}$ also equals $a_A$ plus $a_T$, where $a_T$ is the angle between the track point $P_T$ and the heading of the missile ($P_H$). Because the seeker head 12 is pointed under control of targeting system 14 (FIG. 1), the offset angle $a_O$ between $P_H$ and each edge of the field of view is known. Thus, $a_A$ may be calculated by the equation:

$$a_A=a_{AT}-a_T \quad \text{EQ. (2)}$$

The angle $a_T$ is in turn calculated from the equation $$a_T=a_O-a_R \quad \text{EQ. (3)}$$

where $a_R$ is the angular distance between the track point $P_T$ and the edge of the field of view (not numbered) which is computed by counting the number of vectors between the edge of the frame and the vector corresponding to track point $P_T$.

Figure 3D:
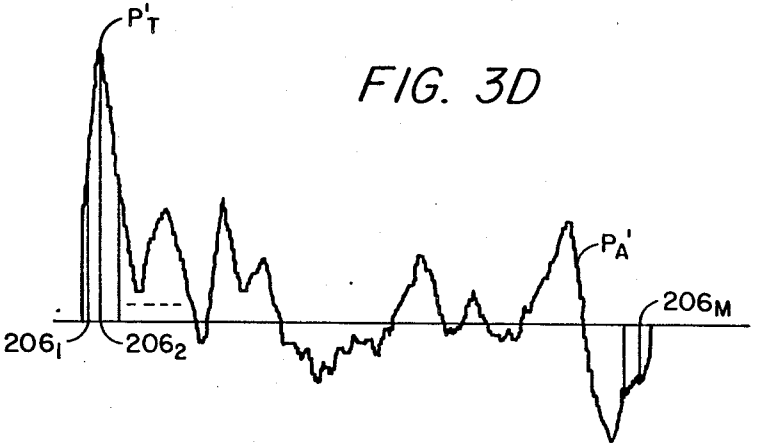
FIG. 3D is a graphical representation of the differential vectors formed according to the invention from the vectors in FIG. 3C.
Figure 3C:
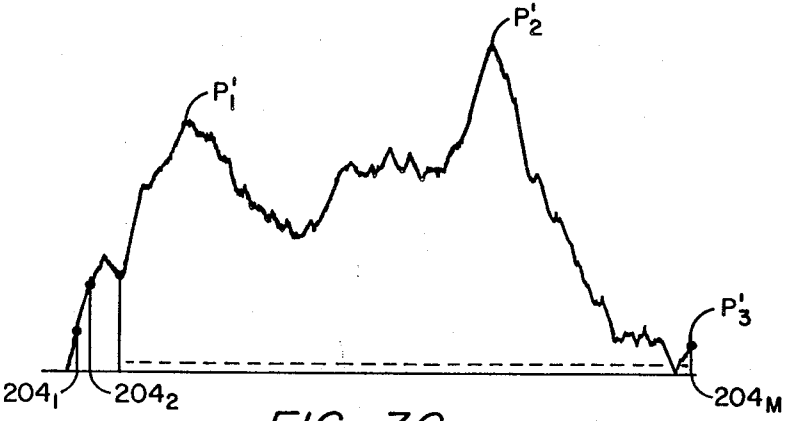
FIG. 3C is a graphical representation of vectors used to characterize an image of the exemplary scene used to form the vectors in FIG. 3A but formed at a time after the image in FIG. 3A.

Next, processing proceeds to processing block 58 (FIG. 2A). A different frame is obtained from the output of seeker head 12 (FIG. 1) at a later time. Vectors will be formed by processing blocks 50B and 52B in the same manner as at processing blocks 50A and 52A. Because the missile 10 (FIG. 1) is approaching the target, the image of the target will take up more of the field of view, making it appear as if the target is growing larger. This "growth" can be seen graphically by comparing the row vectors $204_1$ . . . $204_M$ of the second image shown in FIG. 3C with the vectors $200_1 \ldots 200_M$ of the first image shown in FIG. 3A. The points $P_1$, $P_2$ and $P_3$ in FIG. 3A correspond to points $P_1'$, $P_2'$ and $P_3'$ in FIG. 3C. The distance between the points in FIG. 3C is greater than in FIG. 3A. In addition, the portion of the target which formed the vectors to the right of point $P_3$ in FIG. 3A has "grown" out of the frame and there are no corresponding points in FIG. 3C.

The seeker head 12 is adjusted to keep the track point $P_T$ in the field of view. However, as the missile nears the target, the aim point may fall outside the field of view just like the points to the right of point $P_3$ in FIG. 3A. To be able still to generate control signals once the aim point falls outside the field of view, a growth factor is estimated and used to calculate the position of the aim point. Processing block 60, described in detail below, is used to calculate such a growth factor G. The growth factor G is a scale factor relating the distance between two points in a second image to the distance between the same two points in the first frame. For example, if the distance between $P_1$ and $P_2$ in FIG. 3A is $D_1$, and the distance between $P_1'$ and $P_2'$ in FIG. 3C is $D_2$, the growth factor between the image in FIG. 3A and FIG. 3C is $(D_2/D_1)$. The same growth factor also applies to computations made on the differential vectors as shown in FIG. 3B and FIG. 3D.

Once the growth factor G is determined, in a manner described in greater detail below, processing block 62 is able to calculate the position of the aim point relative to the track point. Recall that the number of vectors between $P_T$ and $P_A$ are counted in processing block 56 and that such number is designated X. If the image has grown by a factor of G, the difference between $P_T$ and $P_A$ then is GX.

Processing block 64 then calculates the required course correction angle. Using Equation (1), the angle between the aim point and the track point can thus be computed regardless of whether $P_A$ is in the frame and is given by $$a_{AT}=GX(a_f/N) \qquad \text{EQ. (4)}$$

The required course correction $a_A$ is given by Eq. (2). The angle $a_A$ is passed to control system 16 (FIG. 1) as part of the course correction. If the position of the track point $P_T$ has changed appreciably relative to the edge of the image, processing block 64 will, in a known manner, also generate commands to seeker head 12 (FIG. 1) to move the seeker head 12 (FIG. 1) to bring the track point $P_T$ back to the desired location relative to the edge of the image.

Once commands have been generated by processing block 64, processing returns to processing block 58 where a new frame is obtained for which new course correction commands are generated. The process of obtaining a new frame and computing commands is repeated until the missile reaches the target.

It should be recalled that each image corresponds to a row set of vectors and a column set of vectors. The course correction commands computed for the row set specify the desired heading of the missile in one direction only. The commands computed for the column-set of vectors specify the desired heading of the missile in an orthogonal direction. Thus, the results of the computations on the row-set and column-set together specify the required course correction.

Figure 2B:
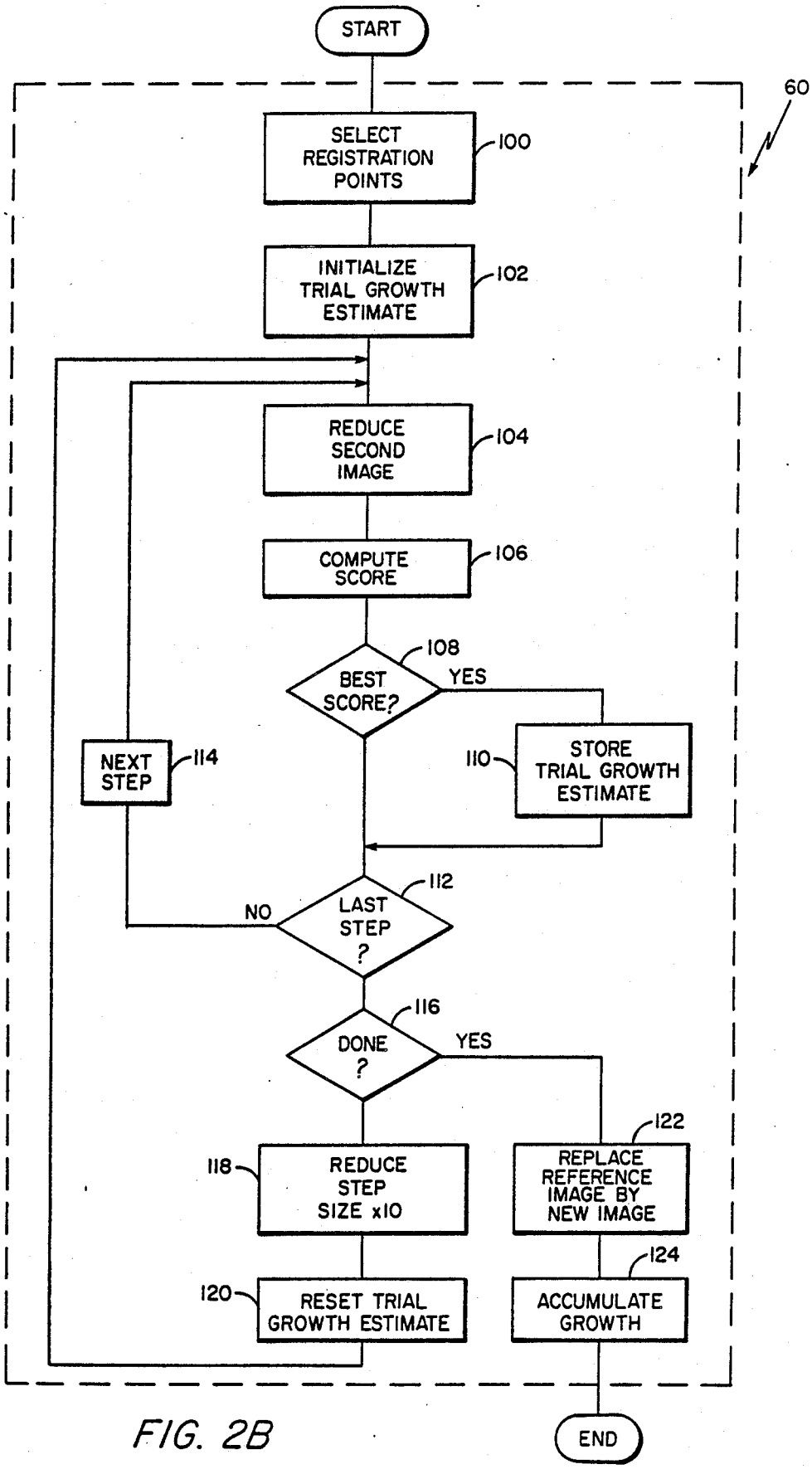
FIG. 2B is a flow diagram of the processing performed by a target identification system of FIG. 2A to complete a growth factor.

Turning now to FIG. 2B, the processing performed by processing block 60 to estimate the growth factor G is shown in greater detail. It should be recalled that the growth factor is computed from sets of differential vectors such as are shown in FIG. 3B and FIG. 3D. As described above, FIG. 3B depicts differential vectors of an image in one frame. FIG. 3D depicts differential vectors from an image of the same target in a second frame formed at a later instant in time.

Returning to FIG. 2B, processing first begins at processing block 100 which selects the track points in two successively derived sets of differential vectors. The growth factor between these two sets of vectors is here denoted $G_o$. Thus, in FIG. 3B showing one set of vectors the track point is labeled $P_T$ and in FIG. 3D, showing the second set of vectors, and the track point is labeled $P_T'$. For notational convenience, say that the track point $P_T$ is represented by the vector $X_T$ from the beginning of its set and $P_T'$ is represented by the vector $X_T'$ from the beginning of its set. The registration points are represented by the vectors $X_T$ and $X_T'$ from the start of their respective sets.

Processing block 102 selects an initial estimate for the growth factor $G_o$. Two successively derived sets of differential vectors are then processed in a manner to be described to test the validity of the estimate. The amount of processing to obtain a satisfactory value of the growth factor $G_o$ depends on how close the initial estimate of the growth factor is to the actual value of the growth factor $G_o$. If the velocity of the missile, V, is a constant and new frames are made for processing every T seconds, the growth will be $$G_o=(R-VT)/R$$

where R is the range of the missile from the target when the first image is made. It follows then that the best initial estimate may be made when the physical parameters R, V and T are known. However, if those factors cannot be conveniently estimated, a constant value, such as 1.00 might be used as an initial estimate of $G_o$.

Once an initial estimate of $G_o$ is made, the second set of differential vectors is reduced by that growth factor at processing block 104. The reduction is performed by taking each differential vector in turn. First, the distance between the vector and registration point is computed. Next, that distance is divided by the growth factor and rounded to the nearest integer, say $X_r$. The vector in the reduced set of vectors which is $X'_T+X_r$ from the beginning of the set of reduced vectors is assigned the value of the selected vector.

Once the second image is reduced, it is compared to the first image at processing block 106 and a score is computed by: (1) subtracting, vector by vector, the sets of vectors to find the absolute value of the difference between corresponding pairs of vectors; and (2) adding the absolute values of all the differences. If there is a vector in the first image which does not correspond to a vector in the second image after reduction of the second image in processing block 104, that vector in the first image is ignored in the computation of the score.

Decision block 108 compares the computed score to any previously computed score. If the newly computed score is lower than any previously computed score, the new score is stored in memory at processing block 110 to replace the lowest previously computed score stored in memory.

Another score is then computed using a different estimate of growth factor $G_o$. The estimate of the growth factor is increased by one step. The estimate will only be increased a fixed number of times, say six. If the estimate of the growth factor has not been increased the maximum number of times, decision block 112 diverts execution to processing block 114. Processing block 114 increases the initial estimate by one step. Here, the step starts out as 0.1. Processing blocks 104 and 106 are repeated to compute a new score for the increased growth factor estimate and decision block 108 is executed to see if the new score is lower than any previously computed score.

When decision block 112 determines the maximum number of steps has been taken, processing diverts to decision block 116. Decision block 116 determines if more processing should be done to determine a better estimate of the growth factor $G_o$. Initially, estimated growth factors in steps of 0.1 were tried. If more processing is to be done, processing block 118 reduces the step size by a factor of ten. Here, decision block 116 determines the step size has been reduced twice (i.e., to 0.01 and 0.001).

Processing block 120 resets the estimate of the growth factor $G_o$. The reset estimate is based on the growth factor $G_o$ estimate which provided the lowest score. The new estimate will provide for the smaller steps to be taken around that estimate. For example, if the estimate to produce the lowest score was 1.4, the growth factor estimate might be reset to 1.37. Steps of 0.01 would then be taken so that the growth factor would be estimated with greater accuracy.

Once decision block 116 determines the trial growth factor has been changed the required number of steps, processing proceeds to processing block 122. The new image selected at processing block 58 (FIG. 2A) becomes the reference image to be used the next time a growth factor 13 is estimated. The growth factor $G_o$ stored at processing block 110 represents the growth between one image and a preceding image. As seen in EQ. 4, the total growth G from when the displacements were computed at processing block 56 are required. Thus, processing block 124 computes a value of G from $G_o$. The first time processing block 124 is executed, the growth factor G equals $G_o$. For subsequent times processing block 124 is executed, the new growth factor G equals the old growth factor G multiplied by $G_o$.

It should be noted that numerous variations might be made to the embodiment of the invention shown in FIGS. 2A and 2B. For example, if the image produced by seeker head 12 (FIG. 1) has numerous rows and columns, there would be a corresponding number of vectors to process. To reduce the processing time, small groups of adjacent vectors could be combined into one vector by averaging their values. If, for example, four adjacent vectors were averaged, the amount of required processing would drop by about one-quarter. Alternatively, the need to accumulate growth factors at processing block 124 can be eliminated by comparing successive frames to the frame selected at processing block 48. For that case, the reference image would not be replaced at processing block 122.

In FIG. 2A a track point was selected at processing block 54 to be near the edge of a target. For small targets, the offset between the track point and the aim point is small. For large targets, however, such angle may be very large and even small errors in determining the aim point can cause the missile to miss the aim point by a large distance. For larger targets, therefore, it would be advantageous to point seeker head 12 (FIG. 1) at the aim point and select a track point within the field of view of seeker head 12.

Figure 2C:
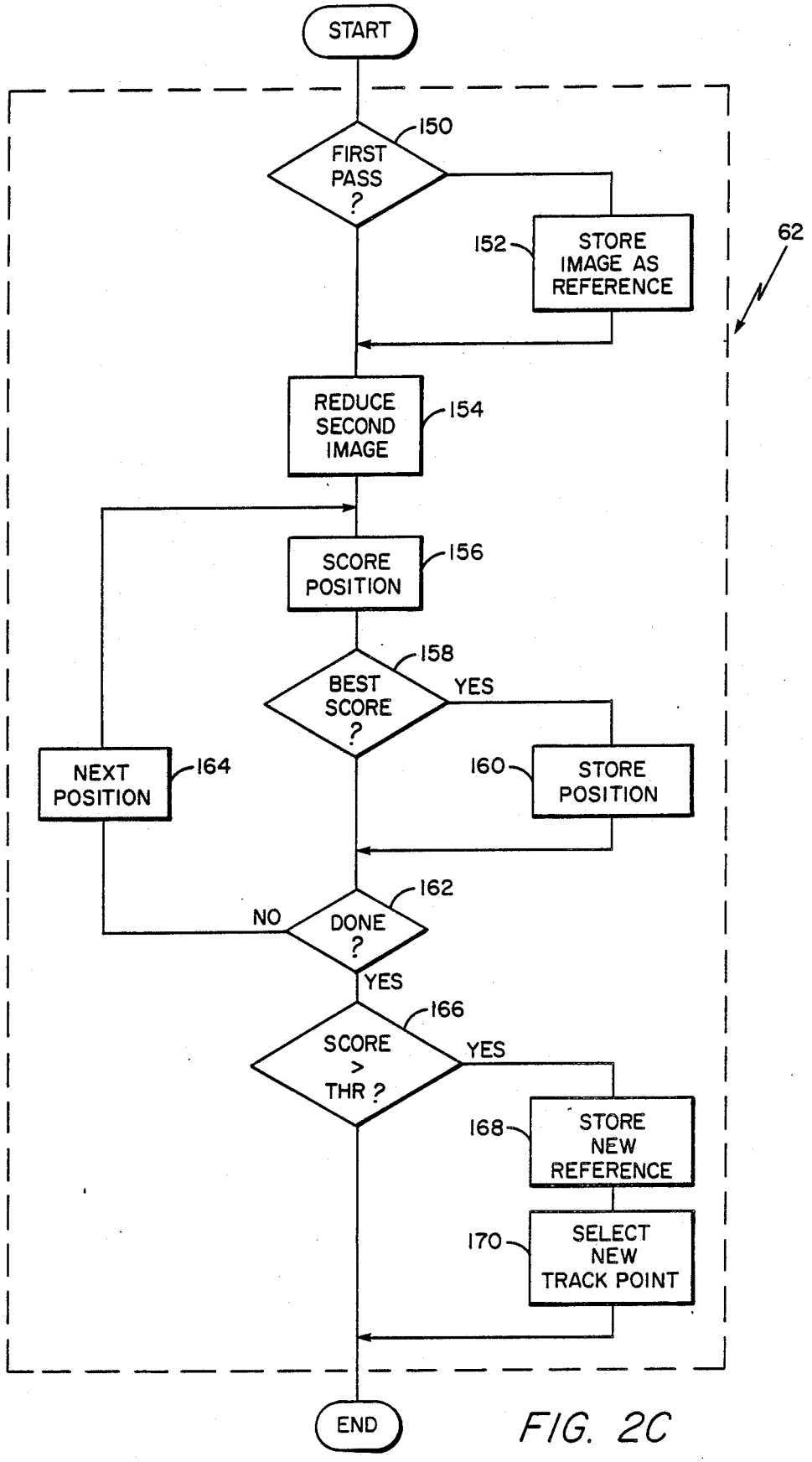
FIG. 2C is a flow diagram of the processing performed to compute an aim point in an alternative embodiment of the invention.

When the track point is selected to be near the aim point, the track point may not be as readily identifiable as when the first peak or largest peak in the set of differential vectors is selected. FIG. 2C, showing a second embodiment of the invention, indicates the processing which would be used in place of that described in conjunction with processing block 62 (FIG. 2A) when the track point is near the aim point.

In FIG. 2A an image is selected at processing block 58 for comparison with the reference image stored at processing block 48. For the embodiment shown in FIG. 2C, the first time processing block 62 is executed, decision block 150 diverts execution to processing block 152. Processing block 152 stores a copy of the reference image since the stored reference may be altered by subsequent processing and processing block 62 should not alter the processing performed in FIG. 2A. Processing block 154 reduces the image by taking the position of the differential vectors in the image and dividing by the growth factor computed at processing block 60 (FIG. 2A). The quotient is then rounded to the nearest integer. The vector at that position in the reduced image is assigned the value of the selected vector. Where the value of two or more vectors would be assigned to the same vector in the reduced image, the value of the vector corresponding to the quotient closest to that integer before rounding is selected.

The reduced image computed at processing block 154 has fewer vectors than the non-reduced reference image. The two images are aligned by matching the reduced image to a subset of the vectors in the reference image. Processing block 156 compares the reduced image to the first subset of vectors in the reference image. A score for that comparison is computed by dividing each vector in the reference image by the corresponding vector in the reduced image. The variance of all the quotients is used as a score. Other methods of comparing the images could be used, but the use of the variance is thought to be effective without requiring extensive computations.

Decision block 158 determines if the score computed at processing block 156 is lower than any scores previously computed and stored. If the score is lower, processing block 160 replaces the stored score with the new score.

Decision block 162 determines if the reduced image has been compared to every subset of vectors in the reference image. If not, processing block 164 selects the next subset of vectors in the reference image and a score for that subset is computed at processing block 156. For example, if the first image contained 100 vectors and the reduced second image contained 80 vectors, the second image would first be compared with the first 80 vectors in the first image. The second image would then be compared to the subset of vectors 2 through 81. The last subset of vectors compared would be vectors 21 through 100.

If the reduced image has been compared to every subset of the reference image, processing continues at decision block 166. At that point, the best score has been stored by processing block 160. The vector in the reduced second image matching the aim point in the reference image is selected as the aim point. That aim point is treated at processing block 64 (FIG. 2A) as described above.

Decision block 166 compares the best score stored at processing block 160 to a predetermined threshold, THR. If the score is above THR, it suggests that the reference image is no longer a good reference for the images being produced by the seeker head 12 (FIG. 1) because the images produced by seeker head 12 (FIG. 1) "grow" as the missile approaches the target. In this case, processing block 168 selects and stores the image obtained at processing block 58 as the reference image. Processing block 170 then selects a new track point and resets the growth factor accumulated at processing block 124 (FIG. 2B) to 1. The new reference image and new track point will be used during the next iteration of processing images from seeker head 12 (FIG. 1).

Having described embodiments of the present invention, it will be clear to one of skill in the art that various modifications could be made thereto without departing from the invention. It is felt, therefore, that this invention should not be restricted to the disclosed embodiment, but rather should be limited only by the spirit and scope of the appended claims.

What is claimed is:

1. A method for deriving guidance signals in the terminal phase of an intercept of a target by a guided missile equipped with an imaging IR seeker, the target being of an extended area and being characterized by a thermal signature indicative of distribution of point sources of IR energy differing substantially from the distribution of point sources of IR energy in the background of the target and the imaging IR seeker being adapted, as the guided missile nears the target, sequentially to form at known intervals of time, a plurality of frames in each of which frames at least a portion of an image of the target appears, thereby providing a set of signals that creates a rectangular MxN pixel matrix of the frame, the changes from frame to frame of the rectangular MxN pixel matrix indicative of the guidance commands to be derived, the method comprising the steps of:

(a) generating, from the set of signals in the first formed one of the plurality of frames, the thermal signature of the target;

(b) selecting a first portion of the thermal signature to serve as a tracking point for the imaging IR seeker and a second portion removed from the first portion to serve as an aiming point for the guided missile;

(c) measuring a first angular displacement between the tracking point and the aiming point and storing a first signal representative of the first angular displacement;

(d) generating, using the set of signals and the stored first signal, guidance commands to maintain tracking of the tracking point by the imaging IR seeker and aiming of the guided missile at the aiming point;

(e) repeating steps (a), (b) and (c) using the set of signals in the next formed one of the plurality of frames to obtain a second signal representative of angular displacement, measured from the tracking point, between the tracking point and the aiming point at a later instant in time;

(f) comparing the first and the second signal to determine a third signal representative of the rate of growth of the angular displacement between the tracking point and the aiming point;

(g) modifying the guidance commands in accordance with the third signal to maintain tracking of the tracking point by the imaging IR seeker and aiming of the guided missile at the aiming point.

2. The method as in claim 1 with the additional step of:

(a) repeating steps (a) through (g) repetitively to modify the guidance commands in accordance with the rate of growth determined by processing the sets of signals in the last and the penultimately formed ones of the frames.

3. In a guided missile having a seeker head for forming an image of a target in each one of sequentially generated frames, an improved method for guiding the missile during the terminal phase of an intercept, such method comprising the steps of:

(a) selecting the image in the first one of the sequentially generated frames as a reference image and representing the reference image by a first set of vectors;

(b) selecting one of the plurality of vectors in the first set of vectors as a first track point and selecting a different one of the plurality of vectors in the first set as a first aim point, and computing a first displacement between the first track point and the first aim point;

(c) representing a second one of the sequentially generated frames by a second set of vectors comprising a plurality of vectors;

(d) computing a growth factor characterizing the difference between the first and second sequential frames;

(e) selecting a vector in the second set of vectors corresponding to the first track point as a second track point, and computing a second aim point displaced from the second track point an amount equal to the first displacement multiplied by the growth factor; and (f) generating control signals to steer the missile towards the point corresponding to the second aim point and steering the seeker head towards the point corresponding to the second track point.

4. The method of guiding a missile as in claim 3 wherein the sequential images are represented by arrays of digital words and wherein the first set of vectors representing the first sequentially generated frames are a first set of differential vectors computed according to a method comprising the steps of:

(a) adding the values of the digital words in each row of the array to form a set of unnormalized vectors having one unnormalized vector for each row of the array;

(b) normalizing the unnormalized vectors by multiplying each unnormalized vector by a scale factor equal to a constant value divided by the value of the largest unnormalized vector;

(c) setting each differential vector equal to the difference between a corresponding normalized vector and the normalized vector preceding the corresponding normalized vector by a fixed number of vectors.

5. The method of guiding a missile as in claim 4 wherein the growth factor is computed according to a method comprising the steps of:

(a) selecting a plurality of trial growth factors;

(b) reducing the number of vectors in the second set of vectors in proportion to each of the plurality of trial growth factors;

(c) comparing each of the reduced second sets of vectors to the first set of vectors and computing a score for each of the reduced second set of vectors indicative of the degree of similarity between the first set of vectors and the reduced second set of vectors;

(d) selecting as the growth factor the trial growth factor used to reduce the reduced second set of vectors which produced the score indicating the highest degree of similarity to the first set of vectors.

6. The method of guiding a missile as in claim 5 wherein the first one of the sequential images is selected as the missile enters the terminal phase and the first aim point is selected to be the center one of the first set of vectors.

7. The method of guiding a missile as in claim 3 wherein there is no vector in the second image corresponding to the second aim point.

* * * * *